US006796854B2

(12) United States Patent
Mello et al.

(10) Patent No.: US 6,796,854 B2
(45) Date of Patent: Sep. 28, 2004

(54) AUTOMATIC ELECTRICAL WEDGE CONNECTOR

(75) Inventors: Keith F. Mello, Manchester, NH (US); Daniel D. Dobrinski, Hillsborough, NH (US); Gordon L. Steltzer, Goffstown, NH (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 10/165,107

(22) Filed: Jun. 6, 2002

(65) Prior Publication Data

US 2003/0228807 A1 Dec. 11, 2003

(51) Int. Cl.[7] ..... H01R 11/09
(52) U.S. Cl. ..... 439/796; 24/136 R
(58) Field of Search ..... 439/796, 783, 439/786, 787, 788; 24/136 R

(56) References Cited

U.S. PATENT DOCUMENTS 1,801,277 A * 4/1931 Kelley ..... 439/783
4,407,471 A 10/1983 Wilmsmann et al. ..... 248/63
4,415,222 A * 11/1983 Polidori ..... 439/807
4,428,100 A 1/1984 Apperson ..... 24/115 R
4,872,626 A 10/1989 Lienart ..... 248/63
5,539,961 A 7/1996 DeFrance ..... 24/136 R
6,076,236 A 6/2000 DeFrance ..... 24/136 R
6,146,216 A * 11/2000 Timsit et al. ..... 439/783
6,547,481 B2 * 4/2003 Grabenstetter et al. .. 403/374.2

FOREIGN PATENT DOCUMENTS

FR 2 718 3000 A1 6/1995

* cited by examiner

*Primary Examiner*—Renee Luebke
*Assistant Examiner*—Ann McCamey
(74) *Attorney, Agent, or Firm*—Harrington & Smith, LLP

(57) ABSTRACT

An electrical wedge connector comprising a shell, and a wedge. The shell defines a wedge receiving passage therein. The wedge is shaped to wedge against the shell when inserted into the wedge receiving passage. The wedge has a conductor receiving channel therein for receiving and fixedly holding a conductor in the shell when the wedge is wedged into the shell. The shell has first portion with a first flexure stiffness generating a first clamping force on the wedge when the wedge is wedged in the first portion of the shell. The shell has a second portion with a second flexure stiffness generating a second clamping force on the wedge when the wedge is wedged in the second portion of the shell.

19 Claims, 6 Drawing Sheets

AUTOMATIC ELECTRICAL WEDGE CONNECTOR

BACKGROUND OF THE INVENTION

1. Field of the Invention

The present invention relates to electrical wedge connectors and, more particularly, to an improved automatic electrical wedge connector.

2. Brief Description of Earlier Developments

Power connectors, such as splice, reducer, or dead-end connectors are used for connecting power distribution conductors by various users such as electrical contractors, electrical utilities, and municipalities. In order to ease installation, which may have to be accomplished outdoors in very difficult access and weather conditions, possibly on "live" overhead wires, users have employed automatic overhead connectors. In automatic overhead connectors, the wedge holding the power conductor in the connector is spring loaded to urge the wedge automatically into the connector. Conductor tension (due to the conductor weight) and friction between wedge and conductor does the rest thereby wedging the wedge into the connector. In order to further simplify installation, overhead power connectors are sized generally to be used with a number of conductors of varying sizes. For example, one overhead connector may be used for connecting conductors from 0.23 inch diameter up to 0.57 inch diameter. This allows the user to select from, and hence have to carry a smaller number of different sizes of connectors at the job site. The structure of a given overhead power connector is capable of supporting the maximum connection loads (such as for example prying loads from the wedge against the connector shell) when connecting the largest size conductor which may be used with the connector. The connector structure is thus sized accordingly. U.S. Pat. No. 6,076,2336 discloses on example of a conventional cable connector which has a body supporting opposing jaws for gripping a cable with wedge action, and a latch plate to retain the jaws in an open position to relieve the cable. Another example of a conventional connector is disclosed in U.S. Pat. No. 4,428,100 wherein the connector has a main body with a recess that has a gripping jaw slideably supported therein. The jaw is held in an open position by release pins. Still another example of a conventional connector is disclosed in U.S. Pat. No. 5,539,961 wherein a spring loaded wedge dead end with jaws spring loaded to a closed position that may be locked open by tabs on a floater. The present invention overcomes the problems of conventional connectors as will be described greater detail below.

SUMMARY OF THE INVENTION

In accordance with the first embodiment of the present invention, an electrical wedge connector is provided. The connector comprises a shell, and a wedge. The shell defines a wedge receiving passage therein. The wedge is shaped to wedge against the shell when inserted into the wedge receiving passage. The wedge has a conductor receiving channel therein for receiving and fixedly holding a conductor in the shell, when the wedge is wedged into the shell. The shell has a first portion with a first flexure stiffness generating a first clamping force on the wedge when the wedge is wedged in the first portion of the shell. The wedge has a second portion with a second flexure stiffness generating a second clamping force on the wedge when the wedge is wedged in the second portion of the shell.

In accordance with a second embodiment of the present invention, an electrical wedge connector is provided. The connector comprises a frame, and a wedge. The frame has at least one shell section with opposing walls defining a wedge receiving passage in between. The wedge is shaped to wedge against the opposing walls of the shell when the wedge is inserted into the wedge receiving passage. The wedge has a conductor receiving channel therein for receiving and fixedly holding a conductor in the shell when the wedge is wedged into the shell. The opposing walls of the shell have stiffeners depending therefrom. The stiffeners are distributed along at least one of the opposing walls with unequal spacing between adjacent stiffeners.

In accordance with another embodiment of the present invention, an electrical wedge connector is provided. The connector comprises a shell, and a wedge. The shell has a wedge receiving passage formed therein. The wedge is adapted to wedge in the wedge receiving passage for capturing a conductor in the shell. The shell has a first end with a rounded outer guide face for guiding the wedge connector into a stringing block pulley when the conductor captured in the shell is pulled over the stringing block pulley.

In accordance with still another embodiment of the present invention, an electrical connector is provided. The connector comprises a frame, and a pair of opposing wedge members. The frame has a shell with a wedge receiving channel. The pair of opposing wedge members are located in the wedge receiving channel for clamping a conductor in the shell. At least one wedge member of the pair of opposing wedge members has a stand off projection which contacts and holds an opposing wedge member at a standoff. The standoff projection has two stop surfaces for contacting the opposing wedge member and holding the opposing wedge member at two different standoffs from the at least one wedge member.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
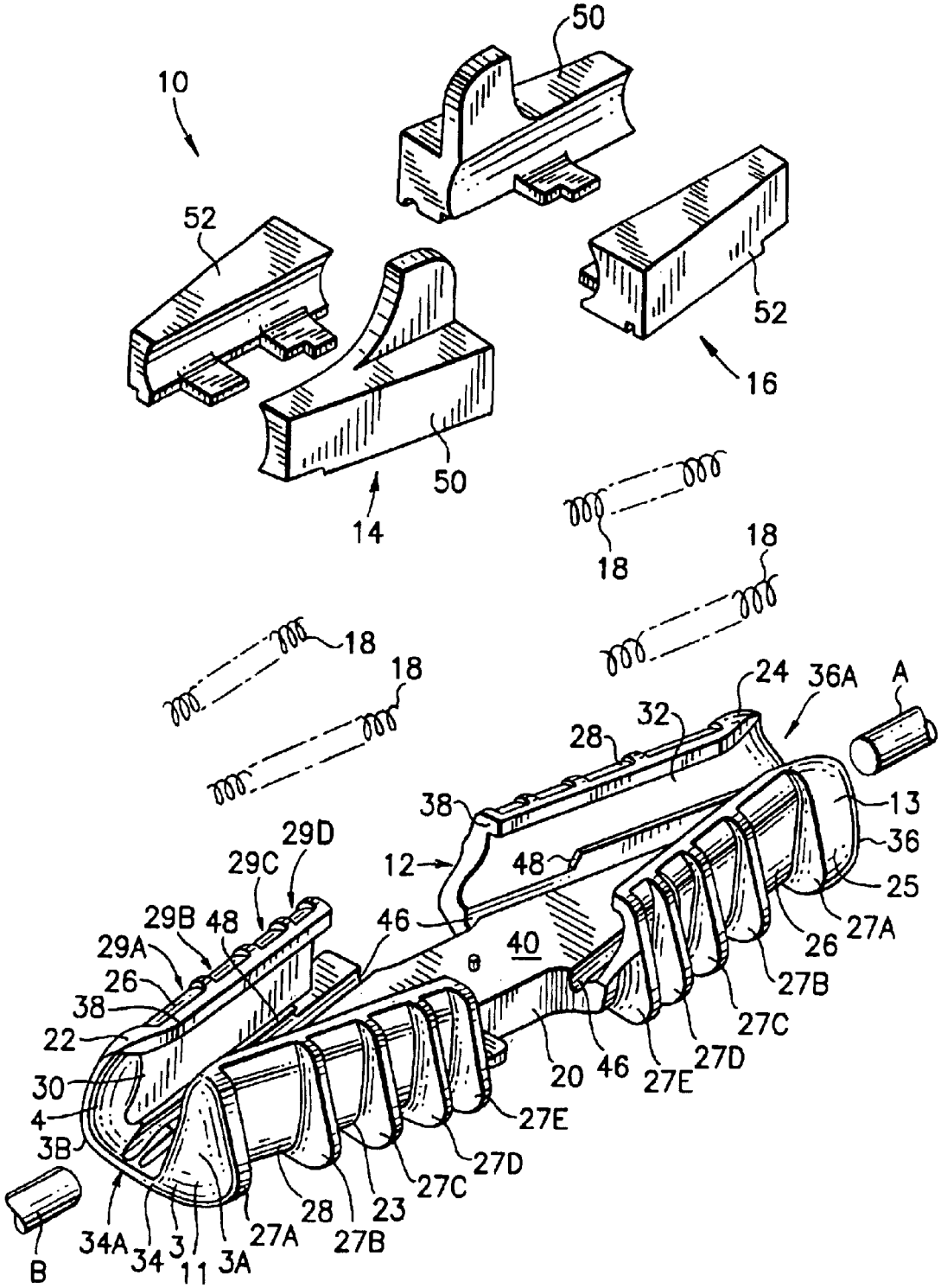
FIG. 1 is an exploded perspective view of an electrical wedge connector incorporating features of the present invention in accordance with one embodiment, and two conductors.

Referring to FIG. 1, there is shown an exploded perspective view of an electrical wedge connector 10 incorporating features of the present invention and two conductors A, B.

Although the present invention will be described with reference to the single embodiment shown in the drawings, it should be understood that the present invention can be embodied in many alternate forms of embodiments. In addition, any suitable size, shape or type of elements or materials could be used.

The connector 10 is depicted in FIG. 1 and described below as being a splice connector intended to connect ends of the two conductors A, B. The present invention, however, applies equally to any other suitable type of connector. The conductors A, B are shown in FIG. 1 as exemplary conductors. Conductors A, B are substantially similar. The conductors may be power conductors, such as for example twisted wire conductors of any suitable size. In alternate embodiments, the conductors may be any other suitable type of conductors, and may have different sizes.

The connector 10 generally comprises a frame 12, a first wedge 14, a second wedge 16, and springs 18. In alternate embodiments less features or additional features could be provided. The first and second wedges 14, 16 are located in the frame 12. The wedges 14, 16 can slide in the frame 12 between an open position and a closed or wedged position. The springs 18 are installed between the frame 12 and wedges 14, 16 to pre-load the wedges to the closed position. The conductors A, B are placed in the corresponding wedges 14, 16 when the wedges are in the open position. The conductors A, B are clamped in the connector 10 when the wedges 14, 16 are moved automatically by the spring pre-load to the closed position as will be described in greater detail below. The connector 10 has features which are substantially similar to connector features disclosed in U.S. patent application Ser. No. 09/794,611, filed Feb. 27, 2001, incorporated by reference herein in its entirety.

Figure 2:
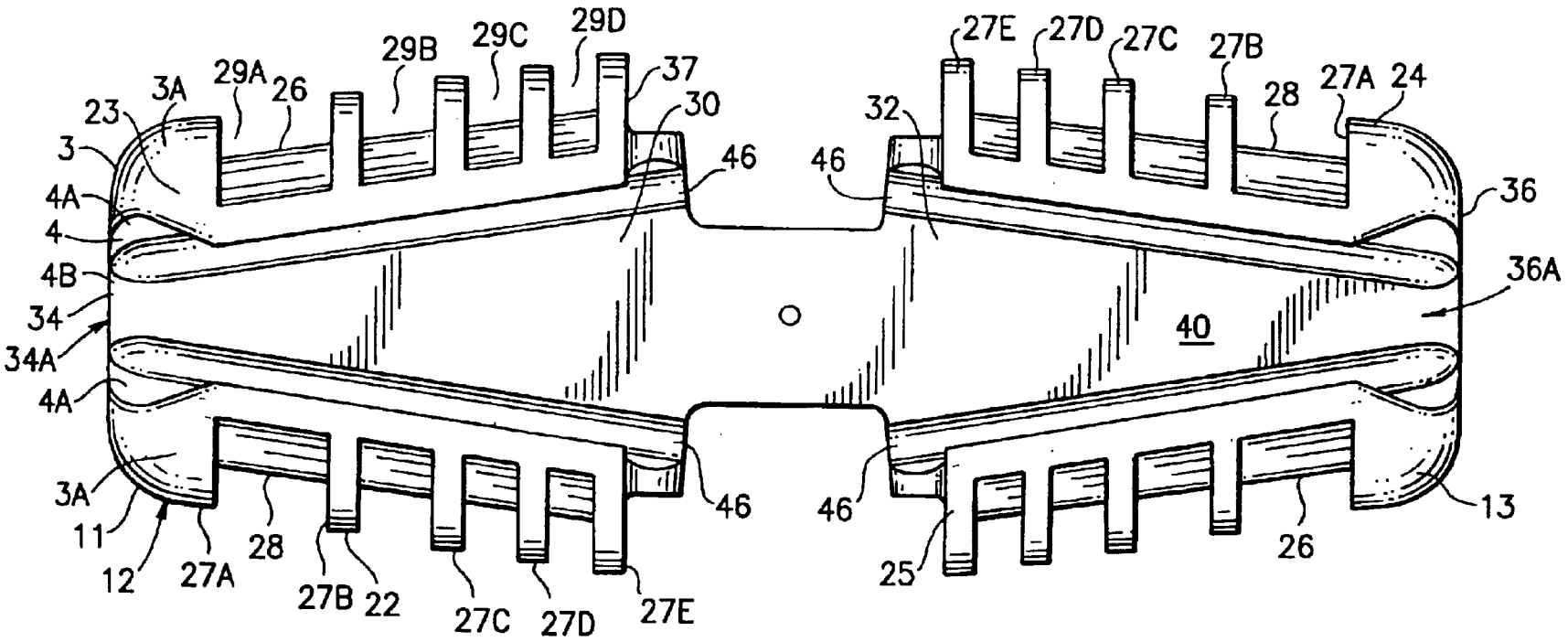
FIG. 2 is a plan view of the frame of the wedge connector in FIG. 1.

In greater detail now, and with reference to FIG. 2, the frame 12 is preferably a one-piece metal member, such as a cast metal member. However, the frame could be comprised of more than one member, could be comprised of any suitable material(s), and/or could be made by any suitable manufacturing process. In the embodiment shown in FIGS. 1–2, the frame 12 generally has a middle section 20 and two end sections 22, 24 connected to each other by the middle section 20. The two end sections 22, 24 are substantially mirror images of each other. However, in alternate embodiments they could be different. Each section 22, 24 comprises an open shell section 23, 25 having a general C shape. Accordingly, each shell section has opposite walls 26, 28 connected by a span wall 40, which will be referred to hereinafter as the bottom wall for convenience purposes only. As seen best in FIG. 2, the opposite side walls 26, 28 of each section 23, 25 are angled relative to each other tapering in from inner to outer ends of the section. Within the shell, the opposite side walls 26, 28 form wedge shaped receiving areas 30, 32. The receiving areas are sized to receive respective wedges 14, 16 therein. Each shell section 23, 25 can have stiffeners to strengthen the sections as will be described further below. Each shell section 23, 25 has a substantially open side (referred to hereinafter as the top side for convenience purposes only) which extends into the receiving areas 30, 32. The tops of the side walls 26, 28 include inwardly extending retaining lips 38. The outer end 34, 36 of each shell section has a conductor passage aperture 34A, 36A into the receiving areas 30, 32. The shell section 23, 25 is sufficiently long to so that the mating wedge 14, 16 may be placed in several positions within the corresponding shell section, such as for example an open position, and several closed positions. In this embodiment the middle section 20 of the connector frame 12 is open on three sides. In this embodiment, the middle section 20 connects the bottom wall 40 of the opposing shell sections 23, 25 to each other. As seen in FIG. 2, the bottom wall 40 also includes spring grooves 46 and guide rails or projections 48. In alternate embodiments the spring grooves and guide rails may be extended into the middle section of the connector frame. In other alternate embodiments the frame could have more or fewer features, arranged in any suitable manner on the frame, and/or the features could have any suitable size or shape.

As noted before, each shell section 23, 25 has stiffeners 27A–27E to strengthen and increase flexural stiffness of the shell section. As the two shell sections 23, 25 in this embodiment are substantially mirror images, the description continues further below with specific reference to one of the sections 23 unless otherwise indicated. In this embodiment, the stiffeners 27A–27E are ribs extending outwards from the opposite side walls 26, 28. The ribs wrap around to extend along the bottom side 40 of the shell section. In alternate embodiments, the shell stiffeners may have any other suitable shape providing the desired stiffness to the shell section. Stiffeners 27A–27E are arrayed along the shell section 23, 25. The shell section 23 of the connector 10 in this embodiment, is shown in FIG. 1 as having five stiffeners 27A–27E for example purpose only. However, the shell section may be provided with any suitable number of stiffeners arrayed along the shell section. The spaces 29A–29D between adjacent stiffeners 22A–27E on the shell section are not equal. As seen in FIG. 1, stiffeners 27C–27E towards the inner end 37 of the shell section are spaced closer together than stiffeners 27A–27B located nearer the outer end 34 of the shell section. As seen best in FIG. 2, in this embodiment, the consecutive spaces 29A–29D between adjacent stiffeners 27A–27E are sequentially smaller from the outer end 34 to the inner end 37 of the shell section. Thus, for example, the space 29A between the outermost stiffener 27A and the adjacent stiffener 27B is greater than the next consecutive space 29B between stiffener 27B and consecutive adjacent stiffener 27C. Similarly, space 29C is smaller than space 29B, but smaller than the next consecutive space 29D. This progression may be continued for additional stiffeners in those alternate embodiments where the shell section may have additional stiffeners. In other alternate embodiments, one or more of the consecutive inter-stiffener spaces may be equal. As can be realized from FIGS. 1 and 2, the variance in the spaces 29A–29D between consecutive adjacent stiffeners 27A–27E provides different portions of the shell section 23 with different flexural stiffenesses. In the embodiment shown in FIGS. 1–2 the closer spacing of the stiffeners 27C–27E towards the inner shell end 37 (i.e. the wide part of the shell, section) causes the commensurate part of the opposite walls 26, 28 of the shell section to be flexurally stiffer than the part of the walls near the outer ends 34 where the stiffeners 27A, 27B are spaced further apart. Moreover the progressive decrease in space between consecutive adjacent stiffeners from outer end 34 to inner end 37 results in the outward flexural stiffeners of the opposite walls 26,28 increasing incrementally as the shell section widens. This allows the connector to be used advantageously with a variety of different size conductors as will be described in greater detail below.

Still referring to FIG. 1, the shell section 23, has a contoured portion 11 at the outer ends 34. Shell section 25 has contoured portion 13 which is a mirror image of portion 11 at outer end 36. In alternate embodiments, only one end of the connector frame may have a contoured portion. The contoured portion 11 at the outer end of the shell section is shaped as will be described further below to cooperate with the pulley in a conventional stringing block as shown in FIG. 5 to facilitate entry and passage of the connector 10 through the block as will also be described further below.

Figures 5, 5A, 6:
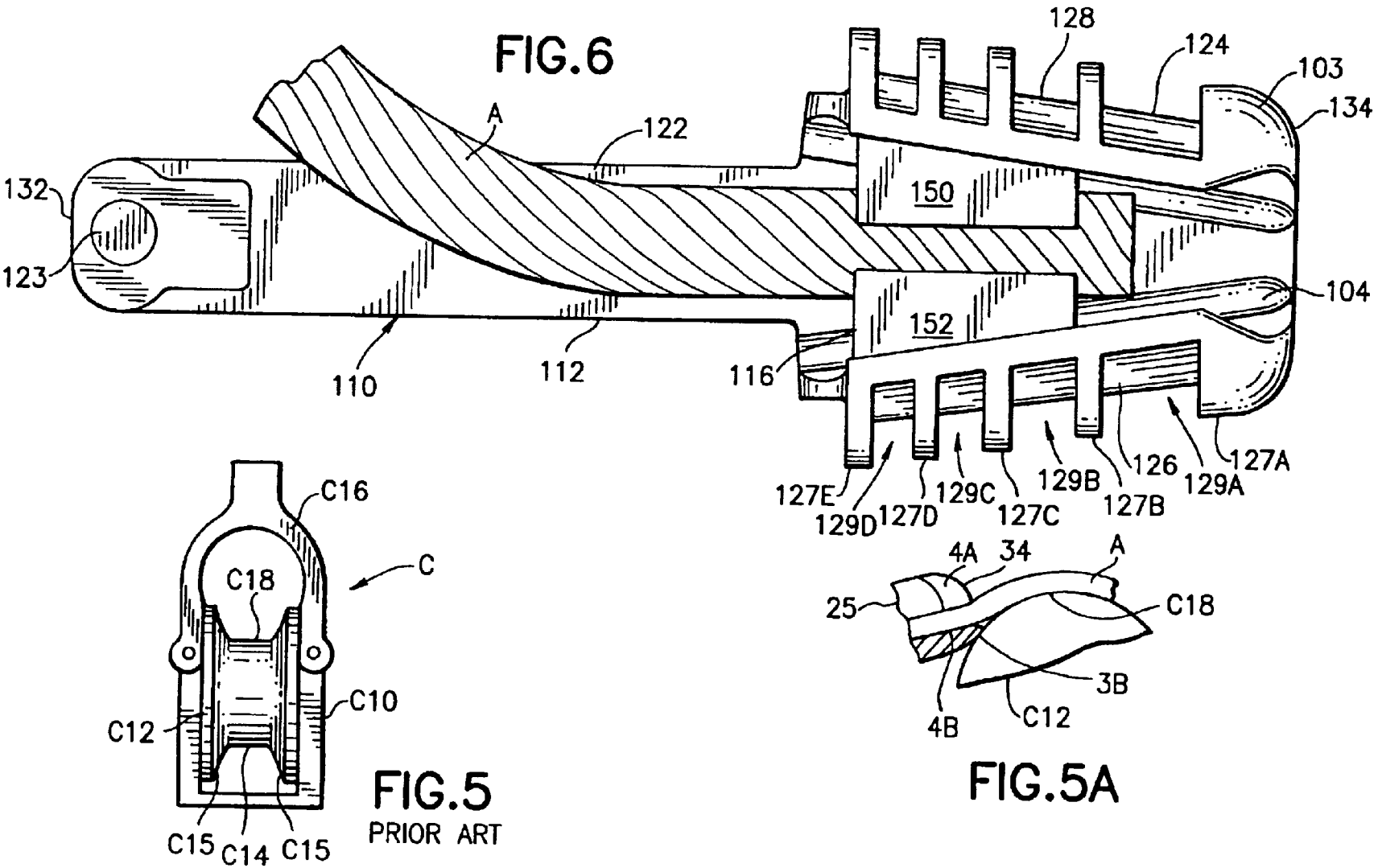
FIG.5 PRIOR ART
FIG. 5 is a perspective view of a conventional stringing block used with the wedge connector in FIG. 1.
FIG. 5A is a partial elevation view of the wedge connector in FIG. 1 seated on the stringing block.
FIG. 6 is a perspective view of a wedge connector in accordance with another embodiment of the present invention.

With reference now to FIG. 5, the conventional stringing block C generally comprises a support clevis C10 and pulley C12 rotatably held in the clevis. The pulley C12 has a curved channel C14 in which a conductor (similar to conductors A, B) lies when it is being pulled over the pulley. The stringing block, as seen in FIG. 5, has a cover or guard C14 over the pulley to retain the conductor on the pulley.

Referring now again to FIGS. 1–2, the contoured portion 11 has a rounded outer guide face 3. The inner surface 54 of the contoured portion 11, which defines the conductor passage aperture into the receiving area 30, is tapered or flared outwards as seen in FIG. 2. The flared inner surface 4 has side portions 4A located on the opposite side walls and a bottom portion 4B across the bottom wall 40 of the shell section 23. The portions 4A, 4B of the inner surface may be flared at any desirable angle in order to provide a smooth transition or support surface without edges against the conductor exiting the connector 10 especially when the conductor in the conductor passage aperture may be somewhat bent. The rounded outer guide face has rounded portions or cheeks 3A on the opposite side walls 26, 28 and a generally radiused lower portion 3B which transitions into bottom portion 4B of the inner surface. In the embodiment shown in FIGS. 1–2, the rounded portions 3A on side walls 26, 68 provide an outward bulging transition from the edge of the conductor passage aperture to the outermost stiffener 27A. In alternate embodiments, the rounded outer guide surface may not extend to the first stiffener of the shell section.

Figure 3A:
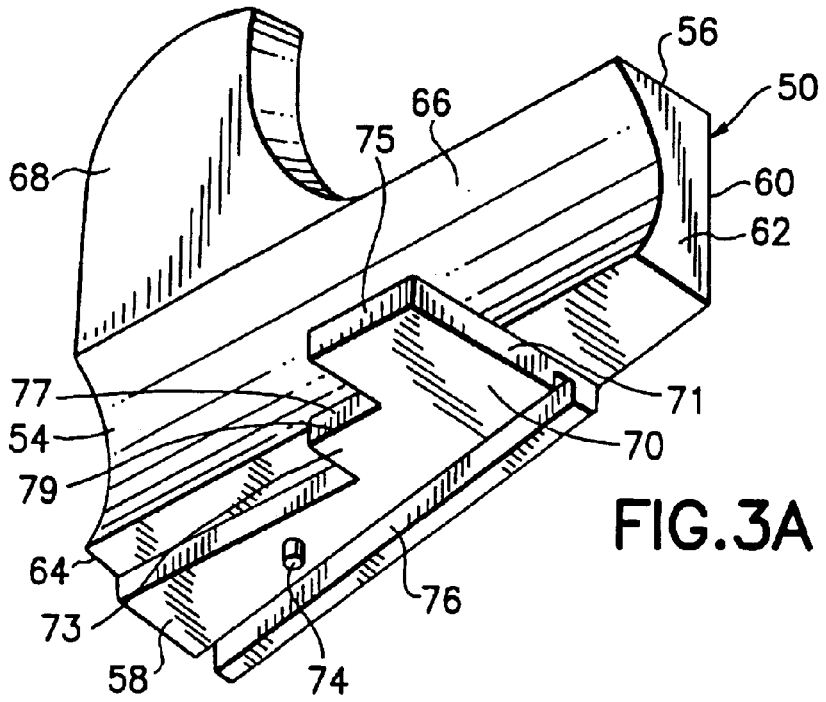
FIGS. 3A–3B respectively are bottom perspective views of the opposing wedge members of the wedge connector in FIG. 1.
Figure 3B:
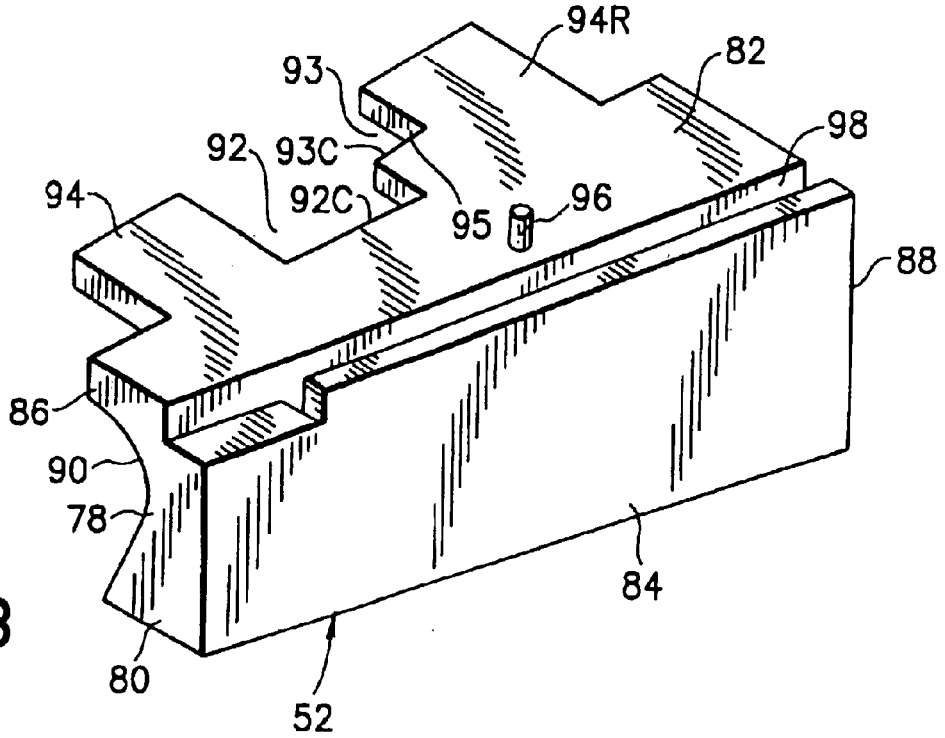

Referring now to FIGS. 1 and 3A–3B, the two wedges 14, 16 are substantially the same, but oriented in reverse orientations relative to each other. However, in alternate embodiments more or less than two wedges could be provided, and the wedges could have different shapes.

In this embodiment each wedge has two wedge members 50 and 52. The wedge members 50, 52 are interlocked as will be described below to operate in unison in the shell section. In alternate embodiments each wedge could have more or less than two wedge members. Each wedge member 50, 52 may be a one-piece cast metal member. However, in alternate embodiments the wedge members could comprise of multiple members, could be made of any suitable material (s), and/or could be formed by any suitable manufacturing process.

The wedge members shown in FIGS. 1, and 3A–3B are exemplary wedge members, and in alternate embodiments the wedge members may have any other suitable form or shape. The first wedge member 50 generally comprises four sides 54, 56, 58, 60 located between a front end 62 and a rear end 64. The inner side 54 has a curved conductor contact surface 66. The inner side 54, proximate the bottom side 58, also comprises a wedge member interlock projection 70. The top side 56 has an actuation or contact section 68 adapted to allow a user to grasp and move the first wedge when in the shell section. However, in an alternate embodiment the contact section might not be provided, or the wedge member may have any other suitable type of section which allows the user to directly manipulate the wedge in the connector. The thickness of the first wedge member 50 between the two lateral sides 54 and 60 increases from the front end 62 to the rear end 64 to form a general wedge shape. The bottom side 58 may include a spring engagement post or section 74, and a groove 76 sized to admit the guide rail 48 in the shell section (see FIG. 1). In this embodiment, the interlock projection 70 is a flat tab which cantilevers outward from the inner side 54 of the wedge member 50. In alternate embodiments, the interlock projection may have any suitable shape. The tab projection has flat sides 71, 73 as seen in FIG. 3A. The tab projection 70 terminates in a substantially flat snubber or stop surface 75. The outer corner along edge 73 of the tab projection is cut to form a step 77 into the tab. The step 77 provides the interlock projection 70 with an inner stop surface 79.

The second wedge member 52 is preferably also a one-piece cast metal member. However, in alternate embodiments the second wedge member could comprise multiple members, be made of any suitable materials(s) using any suitable manufacturing process. As seen best in FIG. 3B, the second wedge member 52 generally comprises four sides 78, 80, 82, 84 located between a front end 86 and a rear end 88. The inner side 78 has a curved conductor contact surface 90. The thickness of the second wedge member 52 between the two sides 78 and 84 increases from the front end 86 to the rear end 88 to form a general wedge shape. The bottom side 82 generally comprises a spring engagement post or section 96, and a groove 98 sized to receive corresponding guide rail 48 in the shell section. The bottom side 82 in this embodiment has an extension 94 which projects from the inner side 78 of the wedge member 52. The extension 94 has a first cutout 92 located and sized to form a sliding fit with the interlocking projection 70 on wedge member 50 (see FIG. 3A). Cutout 92 thus forms an interlock recess for projection 70 when the wedge members 50, 52 are positioned in the shell section. Cutout 92 has a bottom contact surface 92C as shown in FIG. 3B. The extension 94 has an additional cutout 93, which in this embodiment adjoins the rear edge of cutout 92. As seen in FIG. 3, cutout 93 forms a step 95 in the rear portion 94R of the extension 94. The bottom edge of the cutout 93 forms a stop surface 93C for engaging the inner stop surface 79 of the opposite wedge member 50.

Figure 4B:
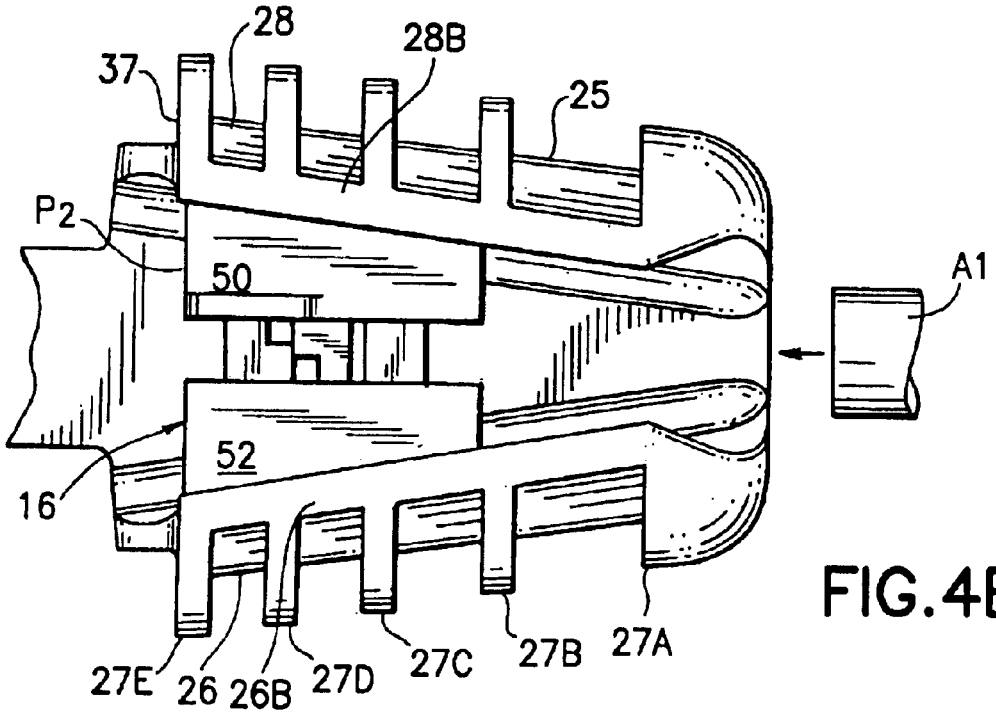
FIGS. 4A–4C are partial plan views of the wedge connector in FIG. 1 respectively showing the opposing wedge members in three positions in the wedge connector.
Figure 4A:
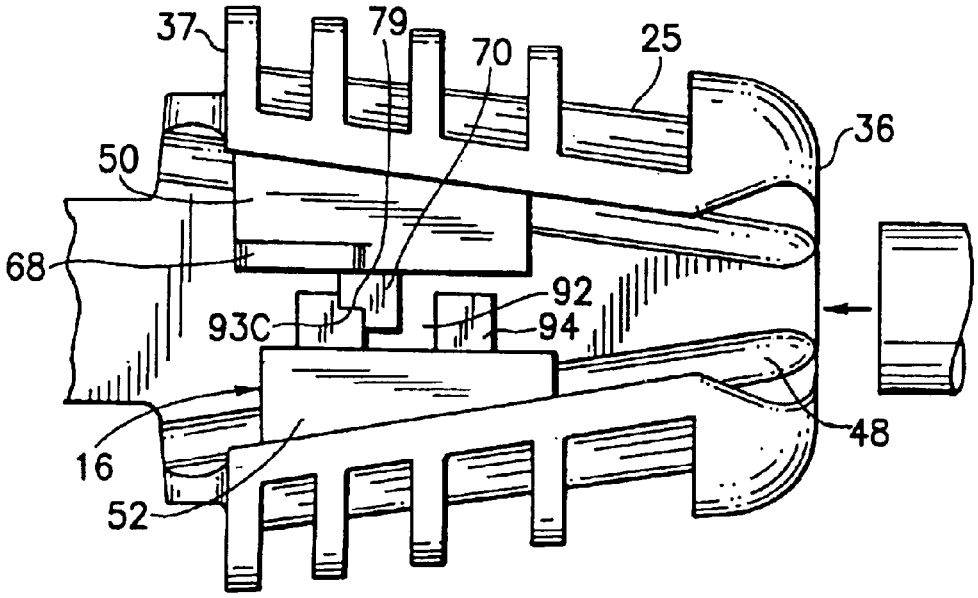
Figure 4C:
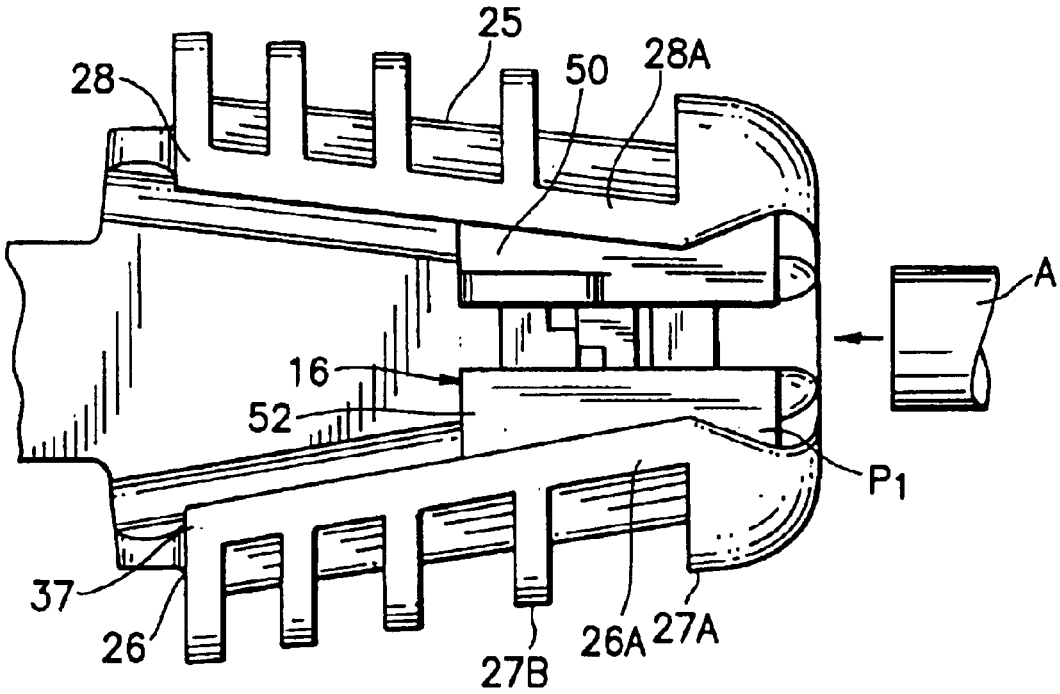

FIGS. 4A–4C are partial plan views of connector 10 which show the wedge members 50, 52 placed in three positions in shell section 25. The placement of the wedge members in the opposite shell section 23 is substantially a mirror image of the placement shown in FIGS. 4A–4C. In FIG. 4A, the wedge members 50, 52 are shown in a latched or open position. This position may be an initial position of the wedge members 50, 52 in the shell section 25. In FIGS. 4B–4C, the wedge members 50, 52 are in two different engaged position. The general placement of the wedge members 50, 52 in the shell is similar in both open and engaged positions. For example, the first wedge member 50 is located with outer side 60 against the inner surface of side wall 28 of the shell section. The bottom side 58 is located against the bottom 40 of the shell section 25 with the spring engagement section 74 extending into respective spring groove 46. One of the guide rails 48 extends into groove 76. The retaining lip 38 of the side wall 28 extend over a portion of the top side 56 of the first wedge member. The second wedge member 52 is located against the inner surface of the opposite side 26 of the shell section 25. The bottom side 82 is located against the bottom 40 with the spring engagement section 96 extending into the respective spring groove 46 similar to wedge member 50. Respective guide rail 48 extends into the groove 98 of the wedge member 52. The retaining lips 38 of the side wall 26 extends over a portion of the top side 80. Thus, both wedge members 50, 52 are stably held in the shell section 25 and allowed to slide back and forth in the shell section along guide rails 48. The rails 48 position the wedge members 50, 52 so that the outer sides 60, 84 of the wedge members 50, 52 contact the inner surfaces of the respective side walls 26, 28 at all positions in the shell section.

The springs 18, in the embodiment shown in FIG. 1, are coil springs, but any suitable springs could be provided. In this embodiment a spring 18 is provided for each wedge member 50, 52. However, in alternate embodiments more or less springs could be provided, such as one spring for each pair of wedge members 50, 52 in the connector. The springs 18 in this embodiment are intended to be compression springs. Alternate embodiments may employ extension springs to pre-load the wedge members into the shell. The springs 18 are located in respective ones of the spring grooves 46. One end of each spring 18 is located against the inward closed end 47 of its respective groove 46. The opposite end of each spring is located against one of the spring engagement sections 74, 96. The compression springs 18 exert forces on the wedge members 50, 52 to bias the wedges 14, 16 along guide rails 48 towards the outer ends 34, 36 of the frame 12. The wedge spring mechanism is a feature that causes the wedges to put an initial force on the conductor, placed between the wedge members during the insertion. The force is such that it maintains enough friction between the wedges and the conductor such that, as the conductor is pulled during installation, it allows the wedges to "set" without the conductor slipping through the wedges. The interlocking features of the wedge member 50, 52 prevent one wedge member from advancing at a different rate than the other. In this embodiment the grooves for the springs are in the base of the body of the connector opposed to the sides of the body of the connector. This allows the wedges to have maximum surface contact with the sides of the body of the connector. This maximizes the friction forces which may be generated between wedges and shell section as well as improving the electrical connection between the conductor in the connector and the frame of the connector.

As seen in FIG. 4A, in the open position, the wedge members 50, 52 are in the widest section of the tapering shell section 25 proximate the section inner end 37. The interlocking projection 70 of wedge member 50 is located partially in cutout 92 in the opposite wedge member 52. The wedge members 50, 52 are offset longitudinally with respect to each other sufficiently to align the step 77 in projection 70 with the mating step 95 in the extension 94. The inner stop surface 79 of wedge member 50 is seated against the outer stop surface 93C of wedge member 52. The bias of springs 18 on the wedge members, along guide rails 48, into the shell section urges the opposing stop surfaces 79, 93C against each other thereby locking the wedge members 50, 52 together. In order to place the wedge members in the open position, once the wedge members 50, 52 are installed in the frame 12, the user may merely press against actuator section 68 to move the wedge towards the inner end 37 of the shell section. As the wedge members move back along rails 48, both members moving in unison due to the interlock between, projection 70 is drawn past stop surface 93C. At the point the spring bias wedge member 52 automatically forces the stop surface 93C into step 74 and against stop surface 79 causing the wedge members to latch. The wedge members are held stably in the open position until unlatched. To unlatch the wedge members, the user presses against actuator 68 toward outer end 36 which causes wedge member 50 to move relative to wedge member 52 until stop surfaces 79, 93C disengage. Once disengaged, the user may release the actuator 68 allowing the spring bias on the wedge members 50, 52 to automatically move the wedges into the shell section to the positions shown in FIGS. 4B–4C. The conductor A is placed between wedge members 50, 52 in the connector 10 when the wedge members are in the open position shown in FIG. 4A. As noted before, after release from the open position, the wedge members automatically move to "grab" the conductor A. Pulling the conductor A during installation thus causes the wedges to "set" in the shell section 25.

As noted before, the wedges 14, 16 may be set in a number of engaged or "set" positions in the shell sections 23, 25 depending on the thickness of the conductors A, B held in the wedges. FIGS. 4B–4C show two partial plan views of the connector 10 with the wedge 16 set respectively in two "set" positions $P_1$ $P_2$ in the corresponding shell section 25. In FIG. 4C the wedge 16 holds a conductor A, and in FIG. 4B the wedge 16 holds a conductor A' which is thicker than but otherwise similar to conductor A in FIG. 4C. Accordingly, the wedge 16 is shown in FIG. 4C as being "set" in a position P1 closer to the outer end 34 of the shell section 25. In FIG. 2B, the wedge 16 is "set" in position P2 which is set inward, closer to the inner end 37 of the shell section 25, relative to position P1 in FIG. 4C. In position P1, the wedge 16 presses outwards against sections 26A, 28A of the shell section side walls 26, 28. In position P2, the wedge presses against sections 26B, 28B of the shell section side walls. As seen from FIGS. 4B–4C, in this embodiment the stiffeners 27A, 27B are spaced further apart over sections 26A, 28A of the side walls than the stiffeners 27C–27E along sections 26B, 28B. Hence, sections 26A, 28A have fewer stiffeners and correspondingly a lower flexural stiffness and strength than section 26B, 28B. Nevertheless, the flexural stiffness and strength of sections 26A, 28A, and sections 26B, 28B respectively are suited to withstand the wedging loads imparted by the wedge 16 when "set" in its corresponding positions P1, P2. The wedging loads imparted by the wedge 16 against sections 26A, 28A, 26B, 28B are dependent on the thickness of the conductors A, A' held by the wedge in the respective positions. By way of example, conductor A' is thicker and hence heavier per unit length than conductor A. Accordingly, the tension loads on conductor A', due to weight for example, are also larger than corresponding tension loads on conductor A. Thus, when conductor A' is held in the connector (the wedge is located in position P2 shown in FIG. 4B), the higher tension loads cause the wedge 16 to impart higher wedging loads than when conductor A is held in the connector. However, as noted before, the higher wedging loads arising from conductor A' are imparted against sections 26B, 28B of the side walls which have the higher flexural stiffness and strength suited to support the higher wedging loads. Lower wedging loads arising with conductor A are imparted by the wedge 16 (in position P1 shown in FIG. 4C) against sections 26B, 28B of the side walls which have a stiffness and strength suited to support the lower wedging loads.

Referring now again to FIGS. 1–2, and 5, after the conductors (such as for example conductors A, B in FIG. 1) are placed and wedged into the connector 10, the spliced conductors may be pulled through stringing blocks (such as stringing block C in FIG. 5) during installation. For example, stringing blocks similar to block C may be used for conductor installation onto power poles. Other guide blocks may be used during conductor installation in large bore conduits or underground pipes. As can be realized from FIG. 5, the pulley C12 in the block C supports the conductor (similar to conductors A, B in FIG. 1) allowing the conductor to be pulled readily over the pulley when being strung onto the poles. As the conductor is pulled and passes through the block C over pulley C12, the conductor rests in groove C14 of the pulley. The conductor has some flexibility even in larger conductor sizes. Hence, as the conductor passes over the pulley, the portion of the conductor resting on the pulley becomes curved somewhat along the curvature of the pulley wheel. When the connector reaches the block, the outer end 34 of the connector contacts the perimeter of the pulley C12 somewhere below the top most region C18 of the pulley (see FIG. 5A). The rounded outer guide face 3, seen best in FIGS. 1–2, contacts the side walls C15 of the groove C14 in the pulley. Continued pulling causes the rounded lower portion 3B of the connector outer end to cam or ride up onto the pulley without catching or snagging on the pulley. As the connector starts to rise on the pulley, outer rounded portions cooperate with the side walls 15C (See FIG. 5) of the pulley groove 14*c* to guide the connector 10 into the groove C14. The flared or tapered inner surface 4B at the outer end 34 of the connector provides a smooth transition for the conductor A between the portion resting on the pulley and the portion in the connector 10. The tapered bottom portion of the outer end 34 of the connector between the inner 4B and outer 3B surfaces (See FIG. 5A) does not cause any sharp edges to be pressed into the conductor A as the connector end is pulled over the pulley C12. Any initial lateral misalignment between the pulley C12 and connector 10 is accommodated by the inner side surfaces 4A (See FIG. 1). The lateral misalignment causes the conductor A to bend laterally at the outer end 34 of the connector. The flared inner side surfaces 4A allow the conductor to bend laterally without resting on any sharp edges at the bend. Flared inner surfaces 4A provide a smooth support surface for the conductor at the bend. The conductor may thus be pulled through the stringing block C without having the connector snag on the block.

Referring now to FIG. 6, there is shown a plan view of a dead end connector 110 in accordance with another embodiment of the present invention, and conductor A installed in the connector. In this embodiment, the dead end connector 110 has a frame 112 with a wedge end section 124 and an elongated handling member 122 depending therefrom. The handling member allows the user to manipulate the dead end connector and/or attach the dead end connector to structure or a handling device. In alternate embodiments, the handling member extending from the wedge section may have any suitable shape. The handling member 122 is shown in FIG. 6, for example purposes, as being an elongated bar or post with at least one attachment hole 123 at the end 132 of the member. The wedge section 124 is substantially similar to the wedge section 22, 24 of connector 10 described before and shown in FIGS. 1–4. Similar features are similarly numbered. The wedge section 124 holds wedge 116 therein. Wedge 116 has two wedge members 150, 152 which are interlocking in a manner similar to that described for wedge members 50, 52 (See FIGS. 3A–3B). The wedge members 150, 152 are automatically set by springs (not shown) similar to springs 18 held in the wedge section 124. The outer end 134 of the wedge section has rounded outer surfaces 103 and flared inner surfaces 104. The side walls 126, 128 have stiffeners 127A–127E separated by sequentially smaller spaces 129A–129D between consecutive adjacent stiffeners. Accordingly, the wedge section 124 has portion with different strength and stiffness corresponding to different positions or the wedge 16 in the wedge section.

As noted before, The structure of a given overhead power connector is capable of supporting the maximum connection loads (such as for example prying loads from the wedge against the connector shell) when connecting the largest size conductor which may be used with the connector. The connector structure is thus sized accordingly. However, in conventional overhead connectors, the connector structure especially the connector shell is substantially uniform or generic having substantially the same strength and stiffness per unit length for the length of the connector regardless of the magnitude of the connection loads imparted on a particular portion of the connector. This results in excess material being used in conventional overhead connectors with a corresponding increase in weight and also cost of the conventional connector. The effect of the excess weight of conventional overhead power connectors is compounded in that, as indicated by their name, overhead power connectors are generally installed overhead, or to be lifted overhead with the conductors. The excess weight of conventional connectors, hence, demands excess effort from the user to install. Connectors 10,110 overcome the problems of conventional connectors in that the connector frame is tailored to provide suitable stiffness and strength in those areas where it is desired. This results in a lighter and easier to use automatic connector which reduces installation costs for power lines.

Furthermore, installation of conductors onto poles, generally used to support overhead utility lines, or in underground conduits, may employ stringing blocks (such as shown in FIG. 5) used to support and guide the conductor as it is pulled to its installed position. During installation of the conductor, the connector, such as for example a dead end connector, may be used to grab onto the end of the conductor during pulling. The connectors are then pulled through the stringing blocks with the conductor. Conventional overhead connectors generally have blunt or flat ends which have a tendency to jam against the stringing blocks when the conductor is pulled. Significant effort may be used to dislodge the conventional connector and pull it and the conductor through the stringing blocks. In sharp contrast to the conventional connectors, automatic connectors 10, 110 have rounded and contoured outer and inner surfaces which facilitate entry and passage of the connector through the stringing block as described.

Further still, automatic overhead power connectors are desired because of the automatic feature which automatically engages the wedge into the connector. Nevertheless, automatic overhead connectors are provided with a latch or lock to hold the wedge in an open or unengaged position against spring bias allowing the conductor to be placed into the connector. Conventional overhead connectors employ a number of latching devices which involve machining of catch facets on both wedge and connector shell or manufacturing separate latch parts used to latch the wedge in the shell. Machining latching facets or edges on the shell of conventional connectors are time consuming because of the complex geometry of the shell (e.g. the shell is more difficult to position and hold in a fixture). Manufacturing separate latch parts dedicated to merely holding the wedge in position in the shell is also costly and inefficient. In the connectors 10, 110 of the present invention the latch features are included on the wedge members. This simplifies manufacturing of the latches in comparison to conventional connectors. Moreover, the latch feature of connectors 10, 110 is easily operated by the user with one hand by merely pushing (on one tab) to engage and then pushing to release the latch.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical wedge connector comprising:

a shell defining a wedge receiving passage therein; and a wedge shaped to wedge against the shell when inserted into the wedge receiving passage, the wedge having a conductor receiving channel therein for receiving and fixedly holding a conductor in the shell when the wedge is wedged into the shell;

wherein the shell has a first portion located along a first length of a first side of the shell, the first portion having a first array of stiffeners with a first flexure stiffness generating a first clamping force on the wedge when the wedge is wedged in the first portion of the shell, and the shell has a second portion located along a second different length of the first side of the shell, the second portion having a second different array of stiffeners with a second different flexure stiffness generating a second clamping force on the wedge when the wedge is wedged in the second portion of the shell.

2. The connector according to claim 1, wherein the shell is a splice connector shell, a dead end connector shell or a reduction connector shell.

3. The connector according to claim 1, wherein the stiffeners depend outwards from opposite walls, the second section of the shell having more stiffeners arrayed along the opposite walls than the first portion.

4. The connector according to claim 1, wherein the shell has a one end with a rounded outer guide face for guiding the connector into a stringing block pulley when the conductor held in the connector by the wedge is pulled over the stringing block pulley.

5. The connector according to claim 1, wherein the wedge comprises a pair of opposing wedge members which define the conductor receiving channel for holding the conductor between the opposing wedge members.

6. The connector according to claim 5, wherein the opposing wedge members are spring loaded to bias the wedge member into the shell.

7. The connector according to claim 1, wherein the wedge is located in the first portion of the shell when the conductor has a first cross-section held in the wedge, and wherein the wedge is located in the second portion of the shell when the conductor has a second cross-section held in the wedge.

8. The connector according to claim 7, wherein the second cross-section is larger than the first cross-section, and wherein the second flexural stiffness is higher than the first flexural stiffness.

9. The connector according to claim 1, wherein the wedge comprises a pair of opposing wedge members adapted for holding the conductor in-between, at least one of the opposing wedge members having a standoff tab for holding an opposing one of the wedge members at a standoff when the wedge is wedged into the shell.

10. The connector according to claim 9, wherein the standoff tab has two support surfaces disposed to hold the opposing wedge member at two different standoff distances when the wedge is wedged into the shell.

11. An electrical wedge connector comprising:

a shell defining a wedge receiving passage therein; and a wedge shaped to wedge against the shell when inserted into the wedge receiving passage, wedge having a conductor receiving channel therein for receiving and fixedly holding a conductor in the shell when the wedge is wedged into the shell;

wherein the shell has a first portion with a first flexure stiffness generating a first clamping force on the wedge when the wedge is wedged in the first portion of the shell, and has a second portion with a second flexure stiffness generating a second clamping force on the wedge when the wedge is wedged in the second portion of the shell, wherein the shell has stiffeners depending outwards from opposite walls, the second section of the shell having more stiffeners arrayed along the opposite walls than the first portion, and wherein the stiffeners are spread along the opposite walls such that a spacing between consecutive adjacent stiffeners decreases from one end of the shell to another end of the shell.

12. The connector according to claim 11, wherein the shell has a tapered shape which narrows towards the one end of the shell.

13. An electrical wedge connector comprising:

a frame having at least one shell section with opposing walls defining a wedge receiving passage in-between; and a wedge shaped to wedge against the opposing walls of the shell when the wedge is inserted into the wedge receiving passage, the wedge having a conductor receiving channel therein for receiving and fixedly holding a conductor in the shell when the wedge is wedged into the shell;

wherein the opposing walls have stiffeners depending therefrom, the stiffeners being distributed along at least one of the opposing walls with unequal spacing between adjacent stiffeners.

14. The connector according to claim 13, wherein the stiffeners are disposed on the opposing walls to resist wedging forces applied by the wedge against the opposing walls when the wedge is wedged in the wedge receiving passage.

15. The connector according to claim 13, wherein the frame has another shell section at an opposite end of the frame from the at least one shell section.

16. The connector according to claim 13, wherein the stiffeners on both opposing walls are distributed along both opposing walls with unequal spacing between adjacent stiffeners.

17. The connector according to claim 13, wherein adjacent stiffeners at a first end of the shell section have a first intra stiffener spacing, and adjacent stiffeners at a second end of the shell have a second intra stiffener spacing different than the first intra stiffener spacing.

18. The connector according to claim 13, wherein spacing between consecutive adjacent stiffeners decreases sequentially from a first end to a second end of the shell section.

19. The connector according to claim 13, wherein the wedge is inserted into the shell section from the second end to the first end.

* * * * *